United States Patent [19]

Mohr

[11] Patent Number: 4,836,589

[45] Date of Patent: Jun. 6, 1989

[54] DOOR LOCK

[76] Inventor: Russel R. Mohr, 103 Vallage Ave., Cannon Falls, Minn. 55009

[21] Appl. No.: 943,570

[22] Filed: Dec. 18, 1986

[51] Int. Cl.[4] ..... E05C 5/02

[52] U.S. Cl. ..... 292/113

[58] Field of Search ..... 292/258, 345, 257, 113, 292/DIG. 49, DIG. 46, DIG. 47, 66

[56] References Cited

U.S. PATENT DOCUMENTS 1,019,226 3/1912 Craigie .
1,239,802 9/1917 Macbeth .
1,288,808 12/1918 Benoit .
2,966,706 1/1961 Christensen ..... 292/113 X
4,062,576 12/1977 Jennings et al. ..... 292/258

*Primary Examiner*—Richard E. Moore
*Attorney, Agent, or Firm*—Merchant, Gould, Smith, Edell, Welter & Schmidt

[57] ABSTRACT

A locking mechanism is provided for doors carried on one or more tracks. The mechanism includes a first member for lodgement in the track, a second member for lodgement outside the track and linkage for drawing the first and second members toward each other to lock the track therebetween.

7 Claims, 2 Drawing Sheets

DOOR LOCK

BACKGROUND OF THE INVENTION

1. Field of the Invention

The present invention is related primarily to the field of locking devices. More particularly, the present invention relates to the field of portable locks which may be clamped onto the side rail of a track as used in conjunction with a rail guided door or window, such as a sliding patio door or garage door.

2. Description of Related Technology

Many solutions have been proposed to the problem of securely fastening and locking a door. The primary requirement of a door locking device is that it securely fasten the door while not interfering unduly with the ability to open and close the door when desired. Usually, a locking mechanism is secured to a door as inherent part of the door or door frame structure. This approach is entirely adequate in those cases where the door is of a sufficient size and a standard configuration, such as a hinged door that is large enough to permit the entry into a room by an average person.

However, many times a door is of such an unusual configuration that an integral locking structure is not practical, either for aesthetic or mechanical reasons. In particular, sliding doors, garage doors and other track-mounted doors and windows have been difficult to lock because of the substantial planar dimensions of the door, the relative thinness of such doors, and the fact that such doors are often custom fitted to a particular application. A custom-made lock could be fabricated in each case, but such an approach would be expensive. The ideal solution to the problem of locking a track-mounted door or window would be to provide a portable locking mechanism of some sort that would be effective on a wide variety of sliding doors, regardless of their particular mounting environment.

Several types of portable locking devices have been utilized in the past. For example, in U.S. Pat. No. 1,019,226, issued to Cragie, the problem of fastening a hatch was solved by mounting a bracket to the external side wall of the enclosure, and retracting an extendable, angled arm which urged the hatch cover downwardly toward the bracket. While the hatch was free of any permanent locking mechanism, this device required that the bracket be permanently mounted to the hatch side wall.

A truly portable locking device was disclosed in U.S. Pat. No. 1,239,802, issued to MacBeth. A pair of coplanar hooks gripped the edge of a door frame, while a hook extending in the opposite direction engaged the door knob. A turnbuckle arrangement urges the oppositely-mounted hooks toward each other, thereby gripping the door knob so as to resist any force that would tend to open the door. Unfortunately, this system is not adaptable to doors which open while remaining in the plane of the door frame.

Thus, the most common solution to securely locking a track-mounted door or window has heretofore been to place a stick or rod of precise length in the door track when the door is fully closed so as to resist any movement of the sliding door member. While effective in some cases, such locking "rods" must be custom made for each particular application and therefore, while portable, may not be transferred from door-to-door unless the respective doors are of identical configuration and dimensions.

SUMMARY OF THE INVENTION

The present invention is a portable lock for use with track-mounted doors and windows. More specifically, the device is a clamp which may be used to prevent, for example, the raising of an overhead garage door. The device includes a vertical member which carries a pivotable arm and a retaining strap. The vertical member may be, for example, a generally rectangular solid, or it may be a rectangular tube. The vertical member serves to block movement of the track mounted door by engagement with a suitable horizontal brace that may be carried by the door, or by contact with a bracket which carries the door roller. A pivotable arm is mounted on a shaft which is secured to the vertical member. The arm carries an outwardly-extending plate or flange to which a rod is secured. The rod is in turn secured to a locking bar member. The rail or track guiding the door is clamped between the two members. By pivoting the arm, the retaining strap may then be pivoted so as to secure the device in the clamped position.

The device is entirely portable, and a single device of average dimensions may be used on a wide variety of track-mounted doors and windows.

DESCRIPTION OF THE PREFERRED EMBODIMENT

The present invention is a portable door lock comprising a clamp which may be rigidly secured to the rail of a track used to guide a sliding door or window. In the preferred embodiment, a pivotable arm is used to secure and release the device from the door track.

Figure 1:
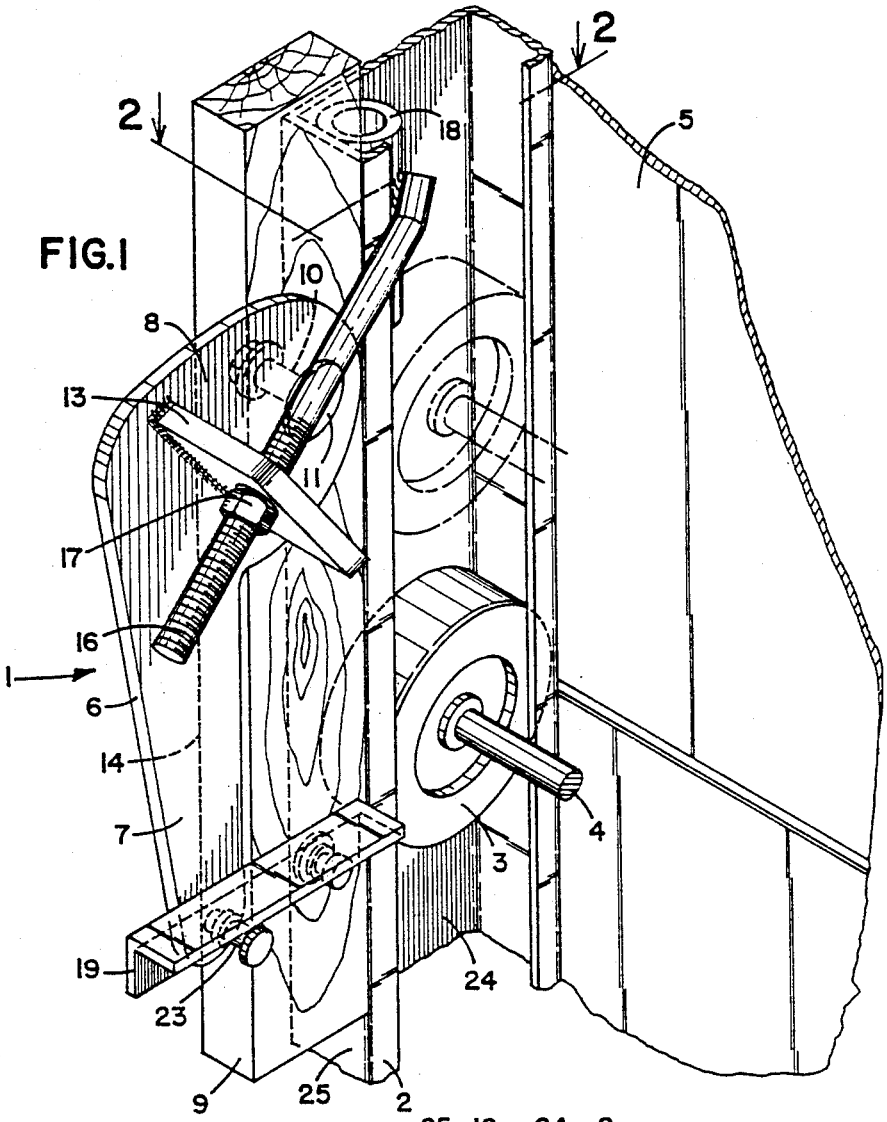
FIG. 1 is a perspective view of a device constructed according to the present invention, shown mounted in a locked position on the rail used to guide a track-mounted door or window.

The present invention can be better understood by referring to the Drawings. In particular, referring to FIG. 1, many of the elements of the present invention may be described. A lock according to the present invention is shown generally at 1. The device is shown affixed in the locked position to a rail 2 which serves as a guide for a track-mounted door. In particular, roller 3 is shown confined within track 24 by rail 2, the axle 4 leading to the door itself (not shown). The track 24 is mounted to a suitable supporting structure such as wall 5.

A lock constructed according to the present invention comprises a pivotable arm 6 which includes a longitudinally-tapered portion 7 and an integral, opposed rounded segment 8. The arm 6 is mounted to a vertical member, such as rectangular bar 9, the bar 9 typically being a piece of metal, plastic or wood such as a one-inch by two-inch plastic bar having a length of approximately one foot.

The mounting of the arm 6 to bar 9 is accomplished by bolt 10 which passes sequentially through rounded segment 8 of arm 6 and bar 9, the head 11 of bolt 10 along with nut 12 thereby securing bar 9 and arm 6 together. One should note that the mounting arrangement of arm 6 and bar 9 just described is such that arm 6 may freely pivot about the longitudinal axis of bolt 11 while being otherwise secured adjacent to the bar 9.

Figure 2:
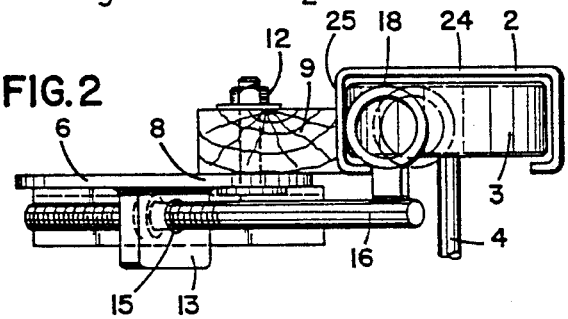
FIG. 2 is a plan view of the device as shown in FIG. 1.

Referring now particularly to FIG. 2, plate 13 is permanently affixed, such as by welding, to arm 6 within the region defined by rounded segment 8. Plate 13 resides in a plane that is substantially perpendicular to the plane defined by arm 6, and is inclined in an approximate 45 degree angle to the longitudinal axis 14 of longitudinal segment 7. The angle of inclination of plate 13 may be varied according to particular applications, but will typically be within the range of 25 degrees to 65 degrees. Located within plate 13 is orifice 15. Extending through orifice 15 is a linkage, such as a partially threaded rod 16. As shown, approximately ½ of rod 16 is threaded. Only the threaded portion of rod 16 passes through orifice 15, the position of rod 16 relative to plate 13 being adjustable by means of retaining nut 17. Near the extreme end of the unthreaded portion of rod 16 is locking bar member 18, the locking bar 18 being permanently affixed to rod 16, such as by welding.

The pivot point of arm 6 is offset from the orifice 15 of plate 13 thereby providing a cam-like action to draw member 8 toward bar 9 into clamping engagement with the door track. The locking bar member 18 may be of any suitable shape and size sufficient to impede the travel of the door or rollers traveling within track 24. In the preferred embodiment, locking bar 18 is a hollow metal rod approximately ½ inch in diameter and 3 inches in length. Bar 18 may have an integral pin 26 which may be lodged in an opening 27 defined in the track 24. The pin 26 prevents bar 18 from sliding along the track. Locking bar member 18 is affixed to rod 16 such that the longitudinal axis of locking bar 18 and the longitudinal axis of rod 16 intersect at an angle of between 15 degrees and 70 degrees.

Figure 3:
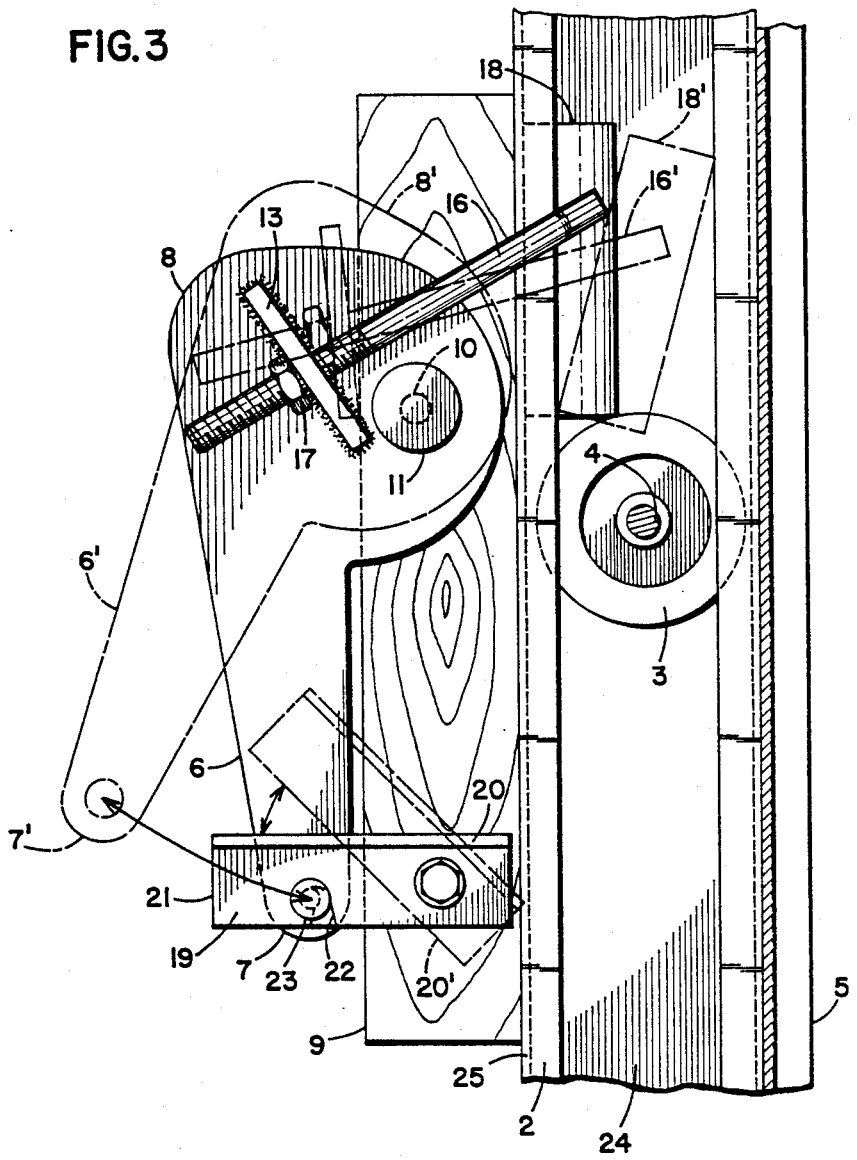
FIG. 3 is an elevation of the device shown in FIG. 1, in which the phantom view shows the device in the unlocked position.

The operation of the device may best be visualized by reference to FIG. 3. The unlocked position of the device is represented by phantom lines and common numbers primed indicate common parts. When arm 6' is in the position shown, threaded rod 16' is in a position that approaches a perpendicular relationship to the longitudinal axis of bar 9. Accordingly, the distance between bar 9 and locking bar 18' is relatively great, thereby permitting the placement of locking bar 18' within the confines of rail 2 while aligning bar 9 with the exterior edge 25 of rail 2. Once locking bar 18' is placed on the opposite side of rail 2 from that occupied by bar 9, the rotation of longitudinal segment 7' of arm 6' towards rail 2 will cause rod 16' to rotate to the position occupied by locking bar 18. If the retaining nut 17 has been properly positioned, rotation of arm 6' to the position of arm 6 will result in rail 2 being securely gripped between bar 9 and locking bar 18.

In order to secure arm 6 in the locked position, a retaining strap 19 may be employed. Retaining strap 19 may be formed of a small length of angle iron or similar material, having a first end 20 pivotably mounted to the bar 9. The second end 21 contains a small notch 22 which is compatibly shaped to engage a post, such as shaft 23 which is mounted on longitudinal segment 7 of arm 6.

While the present invention has been disclosed and described with respect to a particular embodiment thereof, it will be understood by those skilled in the art that various changes in form and detail may be made therein without departing from the spirit and scope of the present invention.

I claim:

1. A locking device for use with a track mounted door, comprising;

(a) a first member, the first member being formed as an elongated bar having a longitudinal axis;

(b) a second member, the second member being formed as having a longitudinal axis;

(c) an arm, the arm being integrally formed as a longitudinally tapered portion and rounded segment, the longitudinally tapered portion and the rounded segment being oppositely disposed; and (d) interconnecting means, the interconnecting means linking the first member and the second member such that rotation of the arm urges the first member toward the second member, said interconnecting means comprising a plate, and a partially-threaded rod, the plate being rigidly mounted to the arm, and containing a centrally-located orifice, the rod being rigidly attached to the first member, the rod passing through the centrally-located orifice, the rod being confined within the orifice by a nut such that by adjusting the nut a particular dimensional relationship is established between the first member and the second member when the arm is rotated into a locked position.

2. The locking device of claim 1, wherein the plate is of a substantially-rectangular shape, the plate residing in a plane that is substantially perpendicular to the arm, the plane of the plate being inclined to the longitudinally-tapered portion of the arm by an angle of approximately 25 degrees to 65 degrees.

3. The locking device of claim 2, wherein the rod is inclined with respect to the longitudinal axis of the first member at an angle of between 15 degrees and 70 degrees.

4. The locking device of claim 2, wherein the longitudinally-tapered portion of the arm has a narrow end, the narrow end being fitted with a post, said post serving to control rotation of said arm, means associated with said post to selectively lock said arm in place.

5. The locking device of claim 4 further comprising a retaining strap, the retaining strap being pivotably attached to the second member, the retaining strap being adapted to engage the post when the first and second member are in a locked position.

6. The locking device of claim 5, wherein the rotating strap contains a notch, the notch being adapted to engage the post on the arm to as to prevent rotation of the arm.

7. The locking device of claim 1 wherein said first member includes a pin for engagement with a door track thereby preventing said first member from sliding along said track.

* * * * *